US005567192A

United States Patent [19]

Cummings et al.

[11] Patent Number: 5,567,192

[45] Date of Patent: Oct. 22, 1996

[54] METHOD AND APPARATUS FOR PROCESSING ELECTRON GAS DISCHARGE TUBING

[75] Inventors: Timothy Cummings, Nashville; Mark Walker, Shelbyville, both of Tenn.

[73] Assignee: Cummings Incorporated, Nashville, Tenn.

[21] Appl. No.: 177,059

[22] Filed: May 31, 1994

[51] Int. Cl.[6] ..... H01J 9/42; H01J 9/44

[52] U.S. Cl. ..... 445/3; 445/26; 445/63; 445/73

[58] Field of Search ..... 445/3, 26, 6, 70, 445/73, 63

[56] References Cited

U.S. PATENT DOCUMENTS

| | | | |
|---|---|---|---|
| 3,249,859 | 5/1966 | Speros et al. | 445/3 X |
| 3,673,652 | 7/1972 | Bonnette | 445/6 |
| 4,514,456 | 4/1985 | Deal et al. | 445/1 X |
| 5,012,194 | 4/1991 | Licter et al. | 445/3 X |
| 5,352,143 | 10/1994 | Brown, III | 445/3 |

FOREIGN PATENT DOCUMENTS

| | | | |
|---|---|---|---|
| 111932 | 7/1982 | Japan | 445/63 |

*Primary Examiner*—Kenneth J. Ramsey
*Attorney, Agent, or Firm*—Wascher & Thomas; Rick R. Wascher; Laura K. Thomas

[57] ABSTRACT

The present invention includes a method and apparatus for processing gas discharge tubing. The apparatus includes a manifold pumping station, a fill and evacuation station and a data acquisition station. The data acquisition station enables the processor of the tubing to input, record and archive manufacturing data such as the identity of the electrode manufacturer, the tube length and diameter, the date of processing the serial number of the tube, the fill gas, the temperature of the glass during processing, the vacuum pressure inside the tube, the current used to bombard the tube, and other variables.

20 Claims, 13 Drawing Sheets

METHOD AND APPARATUS FOR PROCESSING ELECTRON GAS DISCHARGE TUBING

BACKGROUND OF THE INVENTION

1. Field of the Invention

The present invention relates generally to methods of processing electron gas discharge tubing commonly referred to as "neon tubing" or simply "neon," irrespective of the fill gas used for illumination.

More particularly, the present invention relates to a system and method for closely monitoring, recording, or analyzing the neon processing manufacturing parameters in order to correctly and consistently fabricate reliable luminous neon tubing. In addition, the invention is directed to regulating the neon processing parameters to insure conformance with predetermined manufacturing specifications, and allow the manufacturer of the luminous neon tubing to retain fabrication data and information for a particular piece of neon throughout the duration of its useful life.

2. Description of the Related Art

The neon fabrication industry has developed over the years through trial and error in conjunction with an apprentice/journeyman training system. The production of electron gas discharge tubing is often thought of as an art form. In reality, neon processing involves a complex set of variables which must be carefully balanced and regulated to achieve the desired effect within an anticipated environmental setting.

Some of the critical manufacturing parameters include: glass tube length and diameter, ambient operating temperature, gas pressure, mercury vapor pressure, the resident level of impurities from the glass/electrodes or fill gas, current, voltage, electrode composition, fill gas selection, and electrode processing, to name a few. All such parameters affect the final appearance and performance of a neon tube.

Until now, the resultant state of the neon art, therefore, is based on a tremendous amount of conjecture, opinion, and other subjective factors, thereby rendering the consistency of producing reliable high quality neon signage a near impossibility.

Some industry officials have lamented that if five different neon manufacturers were asked about the source or cause of neon failures, it is likely that five different answers would follow. Consequently, there are many examples of bad or failed neon within the sign industry or otherwise on display in public.

Within the last decade, sophisticated instrumentation, such as highly accurate vacuum gauges, thermocouples, and other instruments have been developed to provide much tighter control over the inherent measurable error associated with the processing of neon tubing, including during the bombarding process described below.

In short, the manufacture of luminous tubing utilizes the principles of quantum theory physics to excite the electrons within a low pressure gas by means of a high voltage, low amperage current. Once excited, the gas will emit energy in the form of visible light, ultraviolet radiation, and heat.

The resultant visible light assumes a color characteristic of the individual gas used. Neon gas, for example, produces a red hue while mercury vapor provides a blue/white light. By using additional phosphor coatings inside the glass tubing, or by actually using colored glass, a wide variety of colors can be produced.

Since sufficient mercury vapor pressure is difficult to maintain at ambient temperatures, argon gas is used as a carrier gas to enable the tube to strike an electrical arc between its electrodes. Once the arc is struck, the elevating temperature of the tube increases the vaporization of the mercury, improving the operation of the tube.

Functional electron gas discharge tubing begins with hollow glass tubing. Typically, glass manufacturers ship glass sealed in plastic bags which contain a desiccant. Once opened, boxes of glass tubing should be and are typically stored in a fashion designed to minimize exposure of the tubing to humidity and moisture moisture. At a minimum, the plastic bag should be resealed immediately after the removal of glass for fabrication.

As alluded to above, the glass tubing can initially be clear, coated, colored lead or soda glass as specified by consumer requirements. The diameter of the glass is usually selected to be as large as possible for the particular application. The glass tubing should be free of any accumulation of dust, dirt, and moisture.

The tubing is typically fabricated to conform to an intended design or shape. It is generally understood in the industry that the diameter of the glass should not change by more than ten percent (±10%) when the tubing is bent. All bends should exhibit minimal flatness, and pinching is not acceptable. Glass should be handled and processed so as to ensure proper annealing of the tube.

After the tubing has been bent, welded, shaped, and annealed, the electrodes are welded to each end of the tubing. Due to differences in emission coatings and construction, procedures may vary between suppliers and among different products from the same source. Electrodes will be sized to match glass tubing diameter and intended operating current requirements. The electrode shell must be centered in the glass casing.

The tube is then "tubulated" with a length of slender glass tubing to provide a means for ingress and egress of gases and air. The tabulation is the means to connect the glass tubing to the processing manifold. After the tubing is tubulated, the tubing is slightly evacuated to check for airtightness.

It is also generally understood in the industry that glass tubing should be bombarded the same day it is fabricated, and the glass tubing should be filled with the fill gas and the electrodes energized to test the tube performance. Bombardment processes are classified as open stopcock or closed stopcock, depending on the manner in which the vacuum is applied during, or immediately after, processing of the electrodes.

Bombardment consists of a series of steps which reduce gas pressure within the glass tube to the point that an electric arc can be struck between the electrodes. The amount of the current is controlled so that the glass tube heats to a predetermined processing temperature which is selected to release impurities from within the glass walls which would otherwise be released during normal tube operations. This temperature is usually in the range of 200°–225° C.

If the glass tubing is coated glass, it is processed to an extremely high heat prior to coating, thereby removing many of the impurities within the tubing prior to its delivery to the neon shop. Clear glass which has not been processed in this manner and must be heated ten to fifteen degrees (10°–15°) hotter than coated glass during bombardment to ensure removal of the impurities.

Coated tubes may experience a breakdown of the phosphors and damage to the tube if the glass is processed at too high a temperature. Careful, closely monitored processing in accordance with the present invention is recommended.

The electrodes are also heated in order to convert the emitter material and release still more impurities. After the glass has been heated to the predetermined temperature, the current to the electrodes is increased until they glow "cherry red". In the industry, "cherry red" is a subjective state and is an inherent source of processing error between one piece of neon to the next.

Overheating or underheating of the electrodes is believed to contribute to inconsistent neon tubing life. Closely monitoring the actual electrode temperature would enable the manufacturer of the tubing to stay within the prescribed electrode temperature ranges of a particular electrode manufacturer, thus minimizing one source of manufacturing error.

The impurities are further removed by establishing a vacuum within the tube, after the current source is disconnected from the electrodes. The glass tubing is typically evacuated to a range of 1 micron ($1\times10^{-3}$ Torr) vacuum as measured on the manifold is vacuum gauge.

If the current source remained attached and continued to supply current to the electrodes when the vacuum manifold was opened in order to create the vacuum condition within the tube necessary to remove impurities, the current could attempt to travel the path of least resistance, i.e., through the vacuum gauge and damage the gauge. This condition is known as "flashback."

The tube is then cooled and filled with the appropriate gas and sealed. As mentioned above, some electron gas discharge tubing requires an amount of mercury to be added to the tube along with the fill gas. Due to mercury's instability, triple distilled mercury is typically referred to as an industry requirement. Due to its high degree of reactance, mercury should be stored in a sealed glass container and handled in accordance with all EPA and OSHA regulations.

Until now, a system for monitoring, recording, regulating, and storing the manufacturing parameters associated with the production of electron gas discharge tubing, tracking the useful life of a piece of neon and comparing the useful life data by comparing it to the manufacturing parameters, as well as to determine the best methods of manufacturing, among other things, has not been invented.

SUMMARY OF THE INVENTION

The present invention is directed to data acquisition recording, monitoring, regulating, analysis and other manipulation of the raw data and critical manufacturing parameters associated with the production of high quality neon tubing. The data acquisition system incorporates several sophisticated monitoring operations and pieces of equipment such as an optical pyrometer used to accurately measure the temperature of the electrodes, and Pirani and thermocouple sensors to measure vacuum.

The reports created by the acquisition system of the present invention may be custom tailored to the preferences of a particular manufacturer of electron gas discharge tubing. For example, the manufacturer may require electrode temperature, vacuum or current be plotted versus time or simply provide the maximums or preselected limits of those parameters.

Accordingly, the manufacturer may require the vacuum level within the tubing, the current, or the glass temperature to be plotted as a function of time. In addition, the data acquisition system will enable the processor to make manufacturing comparisons throughout the processing of a particular piece of tubing.

The system is also designed to automatically prompt or instruct the processor to increase temperature or manipulate any of the parameters as determined by a preselected set of manufacturing instructions or interpolations from the useful life data of numerous pieces of quality tubing that have not experienced or undergone problems with operation.

The present inventive method is directed to manufacturing illuminatable tubing in accordance with a prescribed set of manufacturing parameters, usually supplied by the manufacturer of the tubing components used, e.g., the electrodes; as well as furthering the field of knowledge regarding processing of neon tubing.

The method of manufacturing gas discharge tubing therefore includes several steps. After selecting a length of glass tubing having spaced apart open ends, the processor of the gas discharge tubing seals off the open ends by attaching an electrode to each end. The shell of the electrode should be centered in the glass tubing to prevent the shell from overheating the glass and causing it to break or melt.

After the glass is sealed off by the electrodes the glass tubing is tubulated, and the tubulated glass tubing is attached to a processing manifold. The connection to the processing manifold is described below, but is generally accomplished through use of a high-vacuum compression fitting or by directly welding the glass tabulation to the piping of the manifold system.

After the tubulated tubing is attached to the manifold, the processor begins to evacuate the tubing to check for airtightness as mentioned below. When the tubulated tubing is deemed acceptable, the processor or manufacturer applies a bar code identification tag to the tubing.

The identification tag serves as a fingerprint and is designed to be attached to the tubing throughout its useful life after it is processed. Of course, the identification tag may be applied at any time, even after the tube is manufactured, but before manufacturing is most convenient and preferred.

The data acquisition operations of the present invention enable the processor to collect manufacturing data and store it electronically in a CPU or on a computer diskette. If the bar code fingerprint identification is provided before processing, as in the preferred embodiment, the identification will correspond with a newly created data file for the manufacturing data to be loaded corresponding to the particular piece of tubing being manufactured.

In addition, the data acquisition system of the present invention can be configured to prompt the processor with manufacturing commands corresponding to the steps the processor will go through when manufacturing electron gas discharge tubing. Accordingly, the bar code identification could serve as the starting point for the manufacturing processes and related prompts.

The processor scans in the bar code identification by using a scanning wand described below. The signal received by the scanning wand is transformed into useful information, including a serial number. In addition, the processor may be asked, for example, to enter the manufacturing parameter information, including but not limited to, length and diameter of the tube, the manufacturer of the electrodes, the type of fill gas used, the date of manufacture, the identity of the processor, and any other useful identification or manufacturing information required by the processor or the system configuration.

Tubing should be processed on a vacuum-tight glass manifold constructed with laboratory type TEFLON o-ring stopcocks. The glass tubing is preferably 15–18 millimeters in diameter except where tabulation is to be joined to the system. All fittings should be of the high-vacuum type. The connection with the tubulations associated with the glass tubes should be accomplished by welding or by pressure fittings utilizing o-ring seals. The total length of glass in the manifold should be kept to a minimum to ensure more rapid evacuation of the system.

After the tubulated tube is connected to the manifold and the information referenced in the preceding paragraph is provided, the processor begins to evacuate the glass tubing. The data acquisition system may have prompted the processor to perform this and any other step in the manner described above or below, or the user may of his own knowledge have initiated the evacuation.

In any event, the preferred embodiment of the data acquisition system begins to monitor and record the vacuum level in the tube and simultaneously plot the results as a function of time. Of course, depending upon the sensitivity of the instruments used, the recording of data may begin at some predetermined threshold which must be passed before the vacuum data is deemed meaningful or is useful to the processor.

After the appropriate level of vacuum is reached, the processor may close the the stopcock of the manifold (closed stopcock operations) and apply a current source to the electrodes. The electrodes are then energized to prepare the emitter material of the electrodes for use. The current applied to the electrodes causes an arc to pass therebetween and heat the glass. The heating of the glass and electrodes enables impurities within the glass and electrodes to be burned off and released within the tubing.

In the past, the electrodes were heated until they were "cherry red". With the present invention, an optical pyrometer may be used to measure the temperature of the electrodes within a small degree of error. The optical pyrometer and current source are connected to the CPU of the data acquisition system to enable data to be collected during the above processes. In this fashion, the processor can achieve the appropriate level of vacuum or achieve the appropriate temperature as predetermined and in many cases prescribed by the manufacturer of the electrodes. The data acquisition therefore insures compliance with the variables associated with the manufacturing requirements of quality neon tubing.

Once again, the processor may disconnect the current source and again evacuate the tubing to remove impurities. After the impurities have been removed and the data has been collected and recorded, again preferably as a function of time, the processor may begin to introduce the fill gas into the tubing.

Of course, depending upon the application associated with the tube, the processor may be required to add an amount of elemental mercury to the tube in order to provide ultra-violet radiation to stimulate the reaction within the tube, namely the excitement of rare earth phosphors coating the inside of the glass tube.

After the fill gas is introduced, the tubulation is removed from the tubing and the tubing is "burned in" for the prescribed period of time. Again the CPU of the data acquisition system enables the monitoring and recording of the burn in process as well, or the processor can manually add the data at any time.

In the event a particular piece of neon is faulty, the manufacturer can again scan the tube serial number out in the field or back in the shop and retrieve the processing and manufacturing information stored in the file created when the tube was fabricated and put into use. Over a period of time, the information can be stored and comparatively analyzed to determine and predict manufacturing trends, tubing failures, useful life, preferred components, and even optimum manufacturing or processing requirements.

As an exemplary summary of the preferred process, the method steps and the system configuration are listed as follows, and is not intended to be construed as limiting:

The method of manufacturing illuminatable tubing in accordance with a prescribed set of manufacturing parameters includes the steps of providing a length of glass tubing having spaced apart open ends; sealing off the open ends of the glass tubing by attaching an electrode to each of the spaced apart open ends; tubulating the glass tubing; attaching the tubulated glass tubing to a manifold and evacuating the glass tubing; attaching a current source to the electrodes; heating the glass tubing by introducing an electric arc between the electrodes inside the glass tubing to enable the electrodes to bum off impurities; monitoring and recording information corresponding to the current to the electrodes as a function of time and comparing the information to the prescribed set of manufacturing parameters; monitoring and recording information relating to the temperature of the glass tubing as a function of time and comparing the information the prescribed set of manufacturing parameters; evacuating the glass tubing; monitoring and recording information relating to the vacuum within the glass tubing as a function of time and comparing the information to the prescribed set of manufacturing parameters; filling the glass tubing with an inert gas; and sealing the glass tubing.

Of course the processor may also apply a bar code identification tag, reading the identification number with a bar code wedge and recording the manufacturer of the electrode. The processing may also include adding mercury to the glass tubing; burning in the glass tubing; and monitoring the fill pressure of the fill gas.

The system of the present invention may include a length of tubulated glass tubing having spaced apart open ends; an electrode attached to each end of the glass tubing sealing off the tubing: manifold means for controlling the pressure of the gas within the glass tubing; current means for applying an electric current to the electrodes to establish an electric arc therebeteween; thermocouple means for measuring the temperature of the tubulated glass tubing; data acquisition means for monitoring and collecting information relating to: the pressure of the gas within the glass tubing, the amount of current applied to the electrodes, the temperature of the tubulated glass, enabling the manufacturer of the illuminatable tubing to compare the data monitored and collected to be compared to a set of proscribed manufacturing. The system may further include an optical pyrometer for measuring the temperature of the electrode; and the manifold means includes at least one vacuum gauge.

The data acquisition system of the present invention also allows the user, owner, or licensee of the system to generate a host of manufacturing data reports. Such reports, and data screens described more fully below, can be custom configured and arranged at the users' discretion.

DESCRIPTION OF THE PREFERRED EMBODIMENT

Figure 1:
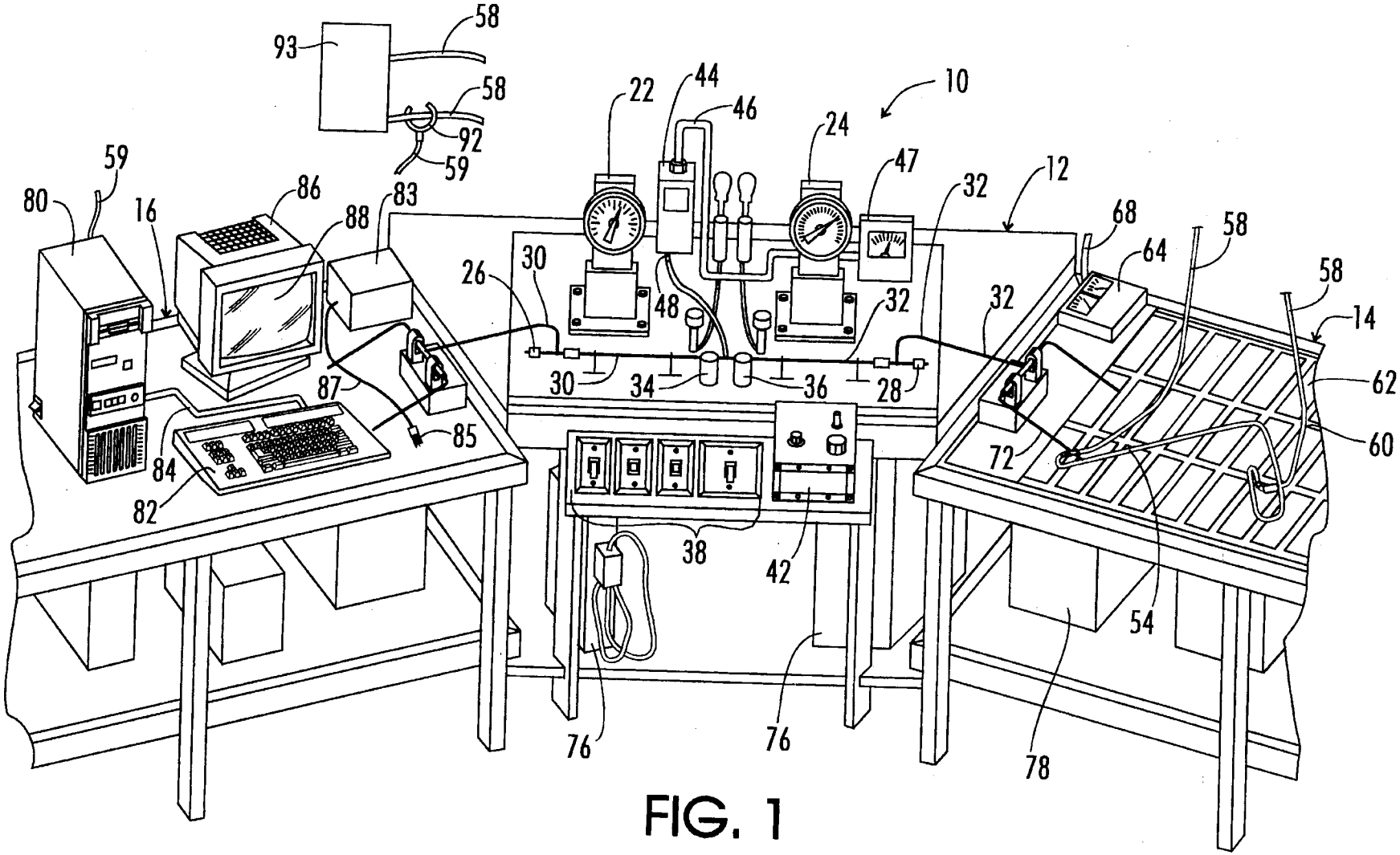
FIG. 1 is a perspective representational view of the processing components of the present invention.

The preferred embodiment of the apparatus of the present invention is designated generally as a system by reference numeral 10. System 10 includes a processing manifold station 12 having at at least one processing tube fill station 14 and a data acquisition station 16.

Figure 2:
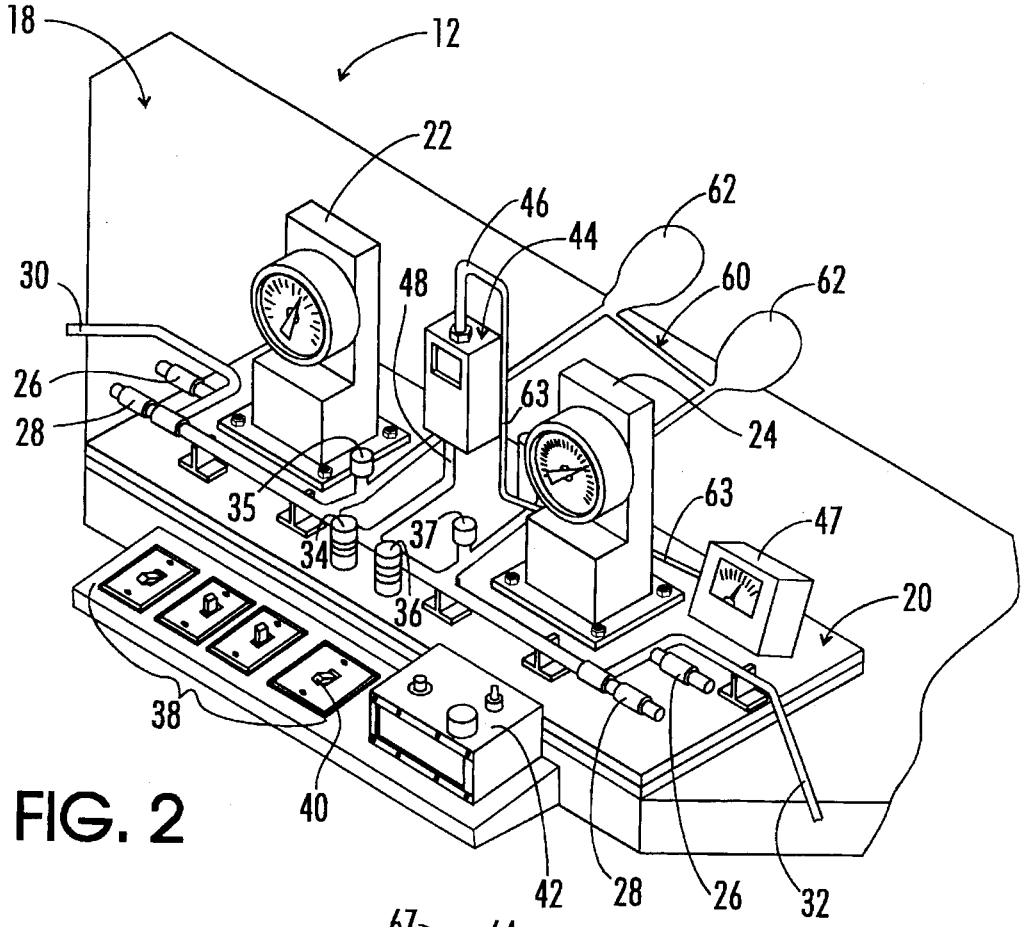
FIG. 2 is an enlarged perspective view of the manifold portion of the processing system shown in FIG. 1.

With reference to FIGS. 1 and 2, manifold station 12 further includes left and right manifold fill assemblies 18 and 20 respectively. Assemblies 18 and 20 respectively include left and right diaphragm analog type vacuum gauges 22 and 24, for example, manufactured by MSVS, Ltd. with a range from zero to forty Torr (0–40 Torr). The gauges 22 and 24 are used to determine upper ranges of vacuum and fill gas pressure using stopcock systems 26 and 28, fill tubing 30 and 32, and control valves 34 and 36.

Control valves 34 and 36 serve to control which processing table will be utilized. In the drawing, for example, a left processing table can be constructed similar to that shown as table 14, but for convenience, station 16 has been drawn in relative alignment with the manifold and fill station 14.

A plurality of switches 38 are shown adjacent the manifold. Switches 38 are used to energize, or control the on/off operation of the various components of the processing system. For example, switch 40 may be used to energize the electrodes of the tubing such that when the switch 40 is thrown a current is applied to the electrodes which causes an arc inside the tubing. Variable resistance rheostat 42 controls and regulates the current incoming and available for use in the system.

With reference to FIG. 2, an Active Pirani type vacuum sensor 44 having a range from one ten-thousandth Torr to fifty Torr (0.0001–50 T) manufactured by Edwards High Vacuum Instruments, Manor Royal, Cawley, West Sussex, England RH10 2LW is connected to an Edwards High Vacuum Gauge 47 by way of electrical conduit 46.

Glass tube 48 connects to the piping of the manifold 30 and 32. Electrical conduit 46 to the gauge 47 is also interfaced with the data acquisition station 16 preferably by a direct electrical data connection between the combination of gauge 47 and sensor 44 on to CPU 80 as should be described hereinbelow.

Figure 3:
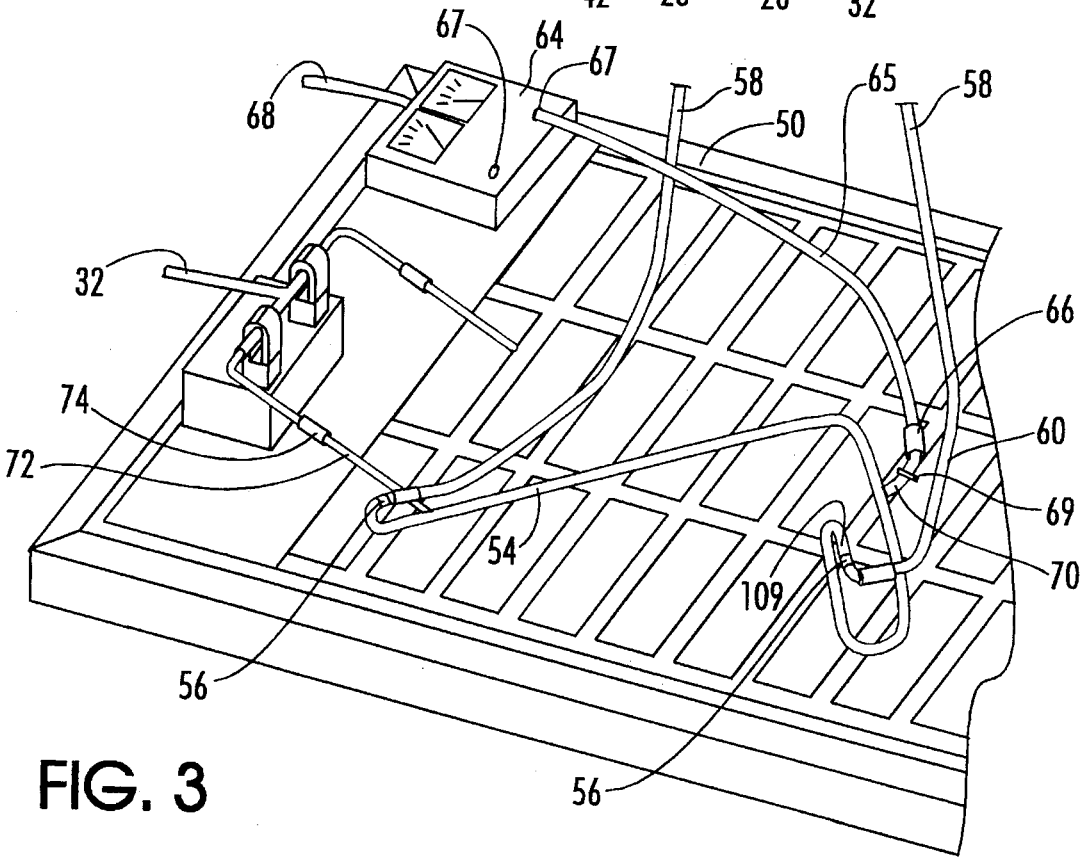
FIG. 3 is an elevated partial perspective view of the fill portion of the processing system shown in FIG. 1.

With reference to FIGS. 1 and 3, the fill station 14 includes a table 50, and at least one fill tube 32. Glass tubing 54 is positioned on the table 50 and has electrodes 56 at each of its ends. Fill flask assembly 60 (FIG. 2) including fill flasks 62 containing fill gas are controlled by valves 35 and 37.

The tube 54 is filled through neck 52. After the tube 54 is filled with gas, or when heating the glass to remove impurities, in a manner as will be described hereinbelow and above, an electrical power source (not shown) is connected to both electrodes 56 by way of an electrical connection 58.

When energized, the connections 58 provide high voltage to the tube 54 causing an arc to be induced and maintained therein between the electrodes 56. As current is applied to the electrodes, the glass tubing 54 begins to heat up. Thermocouple sensor 66 is attached to the CPU by transducer cable 65. A Hastings type high voltage gauge 64 is connected to the CPU 80 by cable 68 and to the thermocouple sensor 66 by cable 65. Thermocouple 66 which measures vacuum in the $1–10\times10^{-3}$ Torr range. Thermocouple 66 is connected to an o-ring fitting 69, which in turn is connected to the glass tubing 54 by tubulation glass 70.

In this fashion, gas introduced into the glass tubing and flows through the fill piping 32, through the neck 52, into tubulation channel 72 connected at o-ring compression fitting 74, and into the glass tubing 54. After the glass tubing is filled, the individual processing the gas discharge tubing heats the tubulation glass 70 and 72 and until the glass material melts separating the discharge tube from the processing manifold maintaining a seal such that the gas pumped into glass tubing 54 does not escape.

With reference to FIG. 1, oil diffusion pump 76, drawn as contained within a rectangular housing may contain a variety of filtering mechanisms (not shown), and other necessary conduits to provide adequate evacuation of glass tubing when, due to low pressures, the gases in the tube exhibit laminar flow characteristics.

Data acquisition station 16 includes a central processing unit (CPU) 80, a standard keyboard 82 connected to the CPU via keyboard/CPU connection cable 84, and a mouse 91. Monitor 86 having screen 88 is also connected to the CPU 80 also by an electrical connection (not shown). During the processing of electron gas discharge tubing, the CPU 80 and monitor 86 having screen 88 will display a variety of informational data to the individual processing the illuminatable tube. An alternate embodiment steps the operator through each stage of the processing by means of predetermined set points and/or activation of various controls by the Data Acquisition Control System. Bar code wedge 83 includes wand 85 and cable 87 collectively capable of reading bar coded information and storing it in the memory locations of the CPU.

Figure 4:
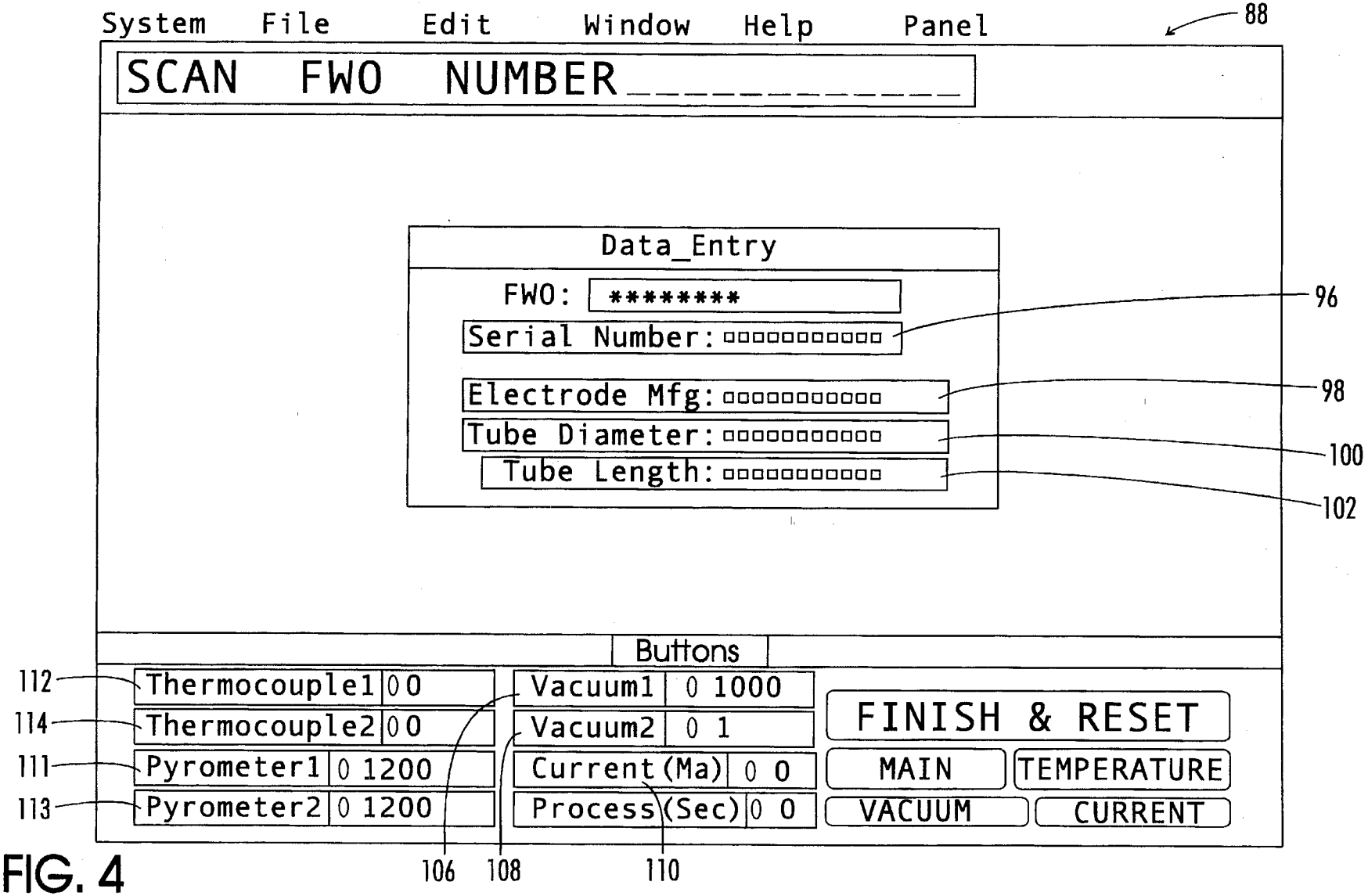
FIG. 4 is a representative view of a computer screen used in accordance with the invention.

With reference to FIG. 4, serial number 96, the identity of the electrode manufacturer 98, the tube diameter 100, and the tube length 102, are all displayed on screen 88 after the corresponding information is read off a bar code by the bar code wedge 90 and wand 92.

Also as described below and in FIG. 4, vacuum read-out 106 and 108 corresponds to the vacuum of the manifold and in the tube such that the "vacuum I" corresponds to the reading on vacuum gauge 24, and "vacuum II" 108 corresponds to a vacuum gauge 64 which may optionally be connected to the end opposite the gas discharge tubing 54 as shown in FIG. 3. Vacuum II readings will only be applicable during final evacuation of tubing 54 due to the narrow range reported.

It is believed to be advantageous to incorporate at least two vacuum readings, one at the near end associated with the manifold, and one at the far end of the glass tubing such that the resultant pressure gradient reading can disclose the actual vacuum achieved in the tube being processed.

Also shown in FIG. 4 is a reference to current 110 as measured by milliammeter 92 connected to bombarding transformer 93 which feeds current to the electrodes of the tube 54 by cables 58, and the information from the milliammeter 92 is fed into the CPU 80 by cable 59 (FIG. 1). Thermocouple I 112 and thermocouple II 114 from thermocouple 66 (FIG. 3) are provided to enable processing of multiple tube simultaneously. Optical pyrometers, designated as Pyrometer I 111 and PyrometerII 113 are displayed in a fashion similar to the readings displayed for vacuum I and vacuum II as described above. The aforementioned current and thermocouple readings may also be displayed on the preliminary screen as indicated in FIG. 4.

Figure 6A:
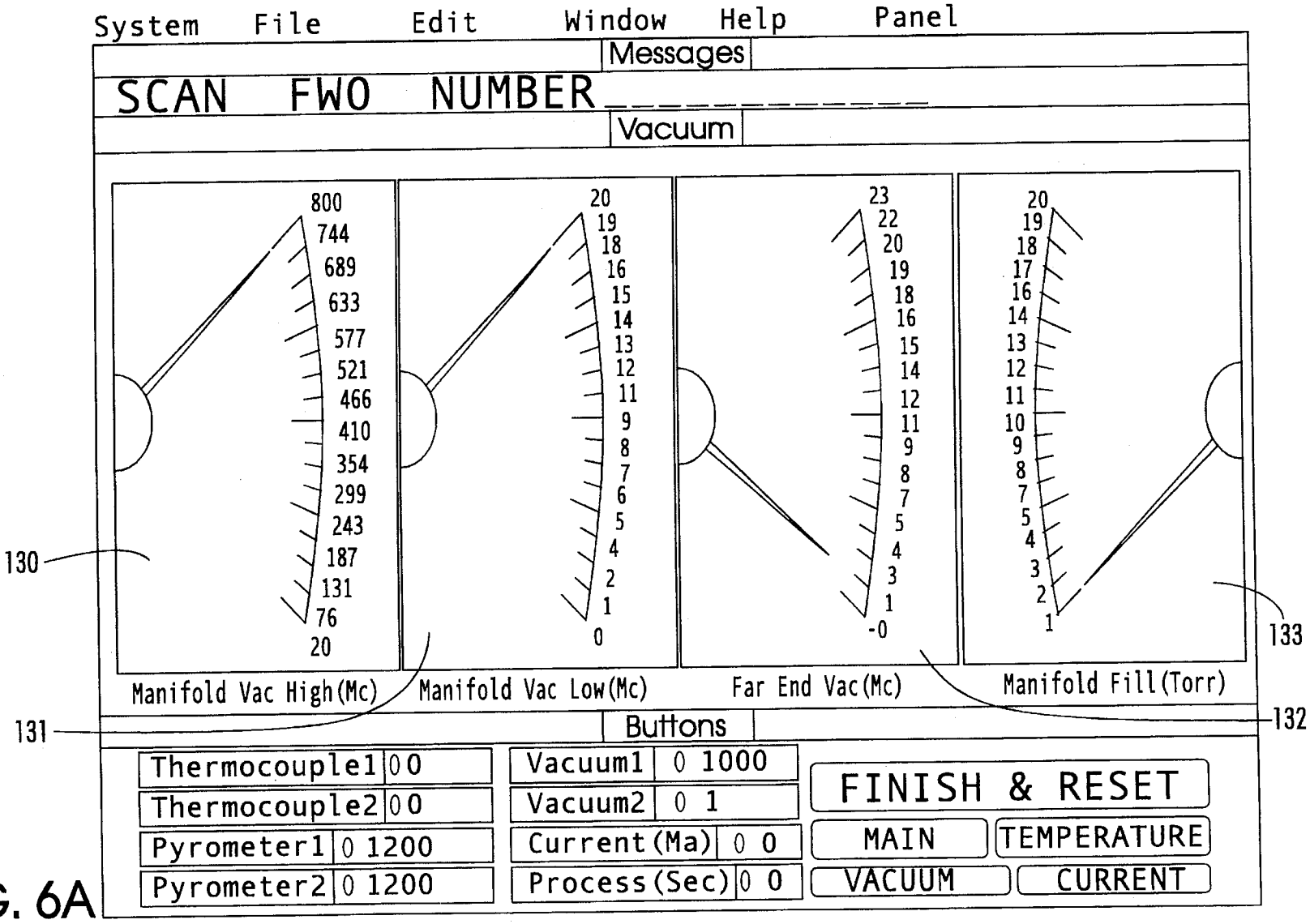
FIG. 6A–6B is a representative view of a series of computer screens used in accordance with the invention.
Figure 6B:
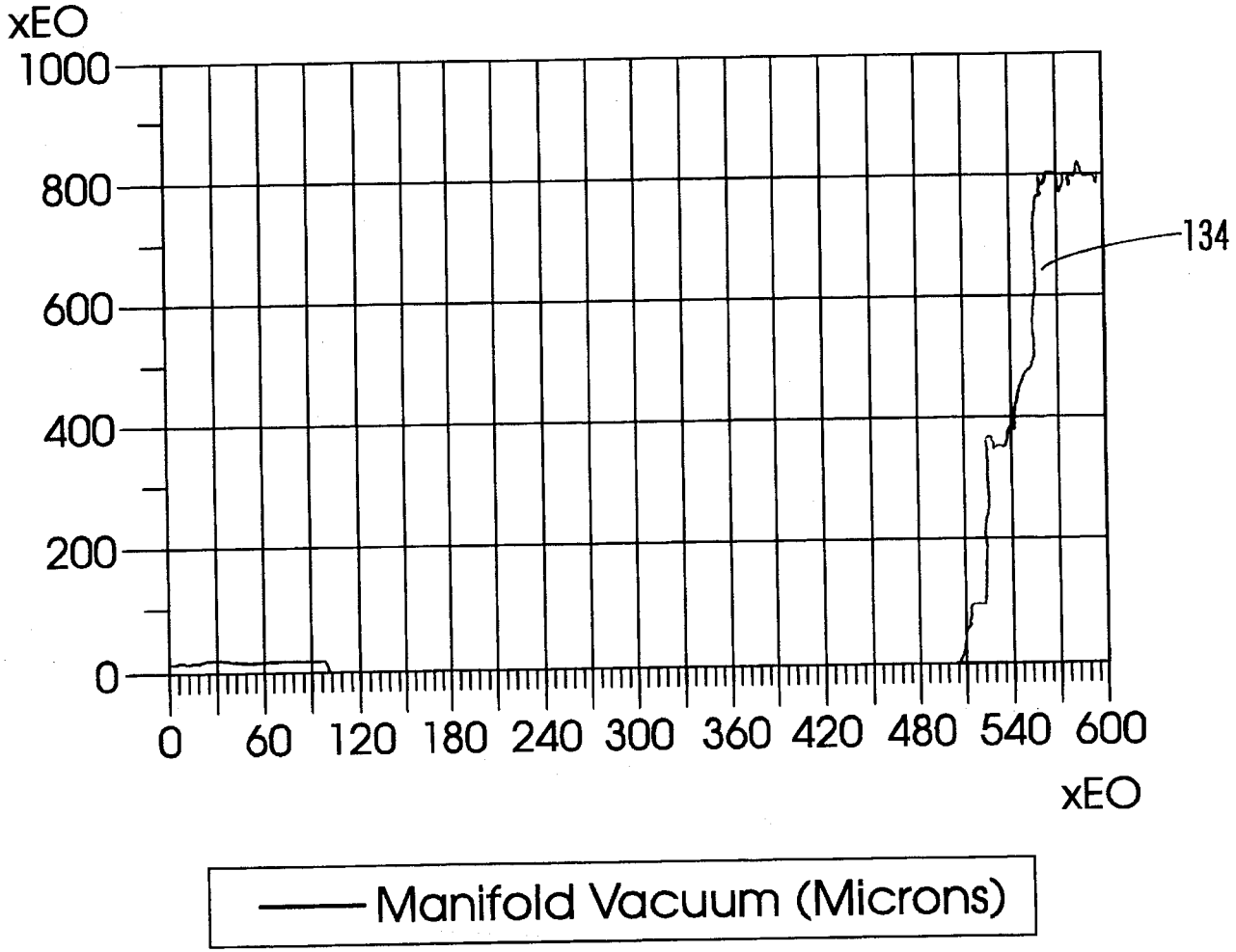
Figure 7A:
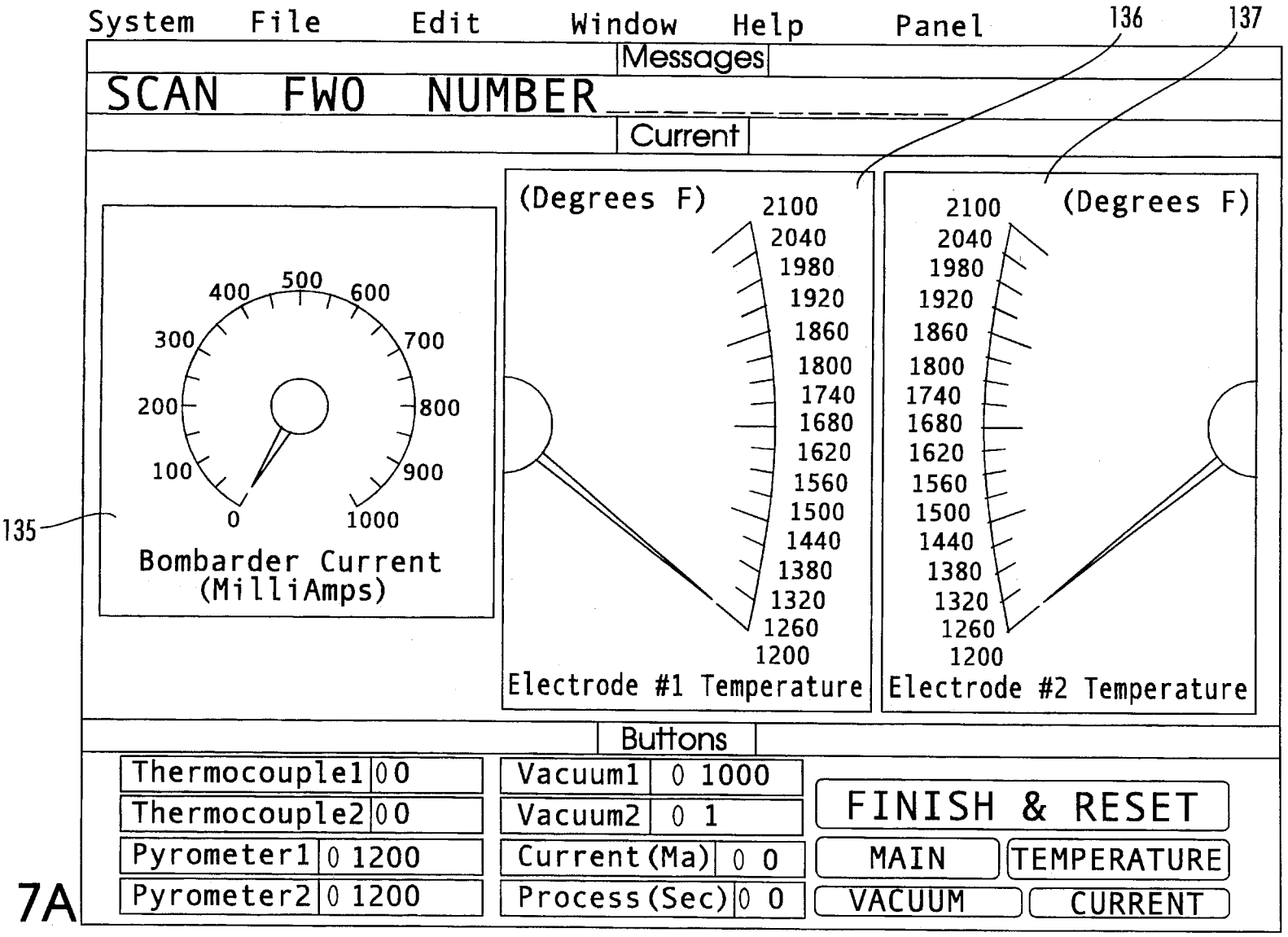
FIG. 7A–7D is a representative view of a series of computer screens used in accordance with the invention.
Figure 7B:
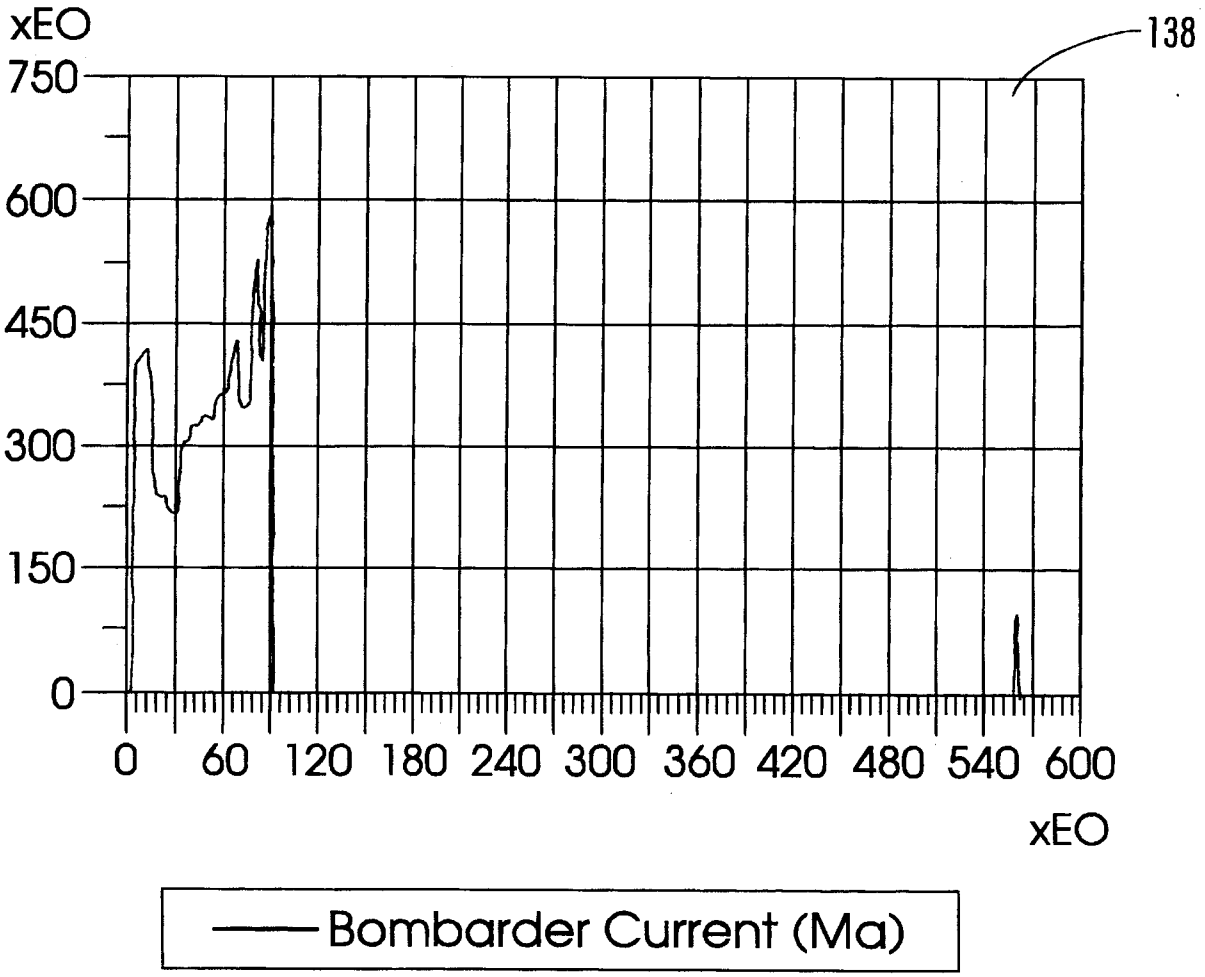
Figure 7C:
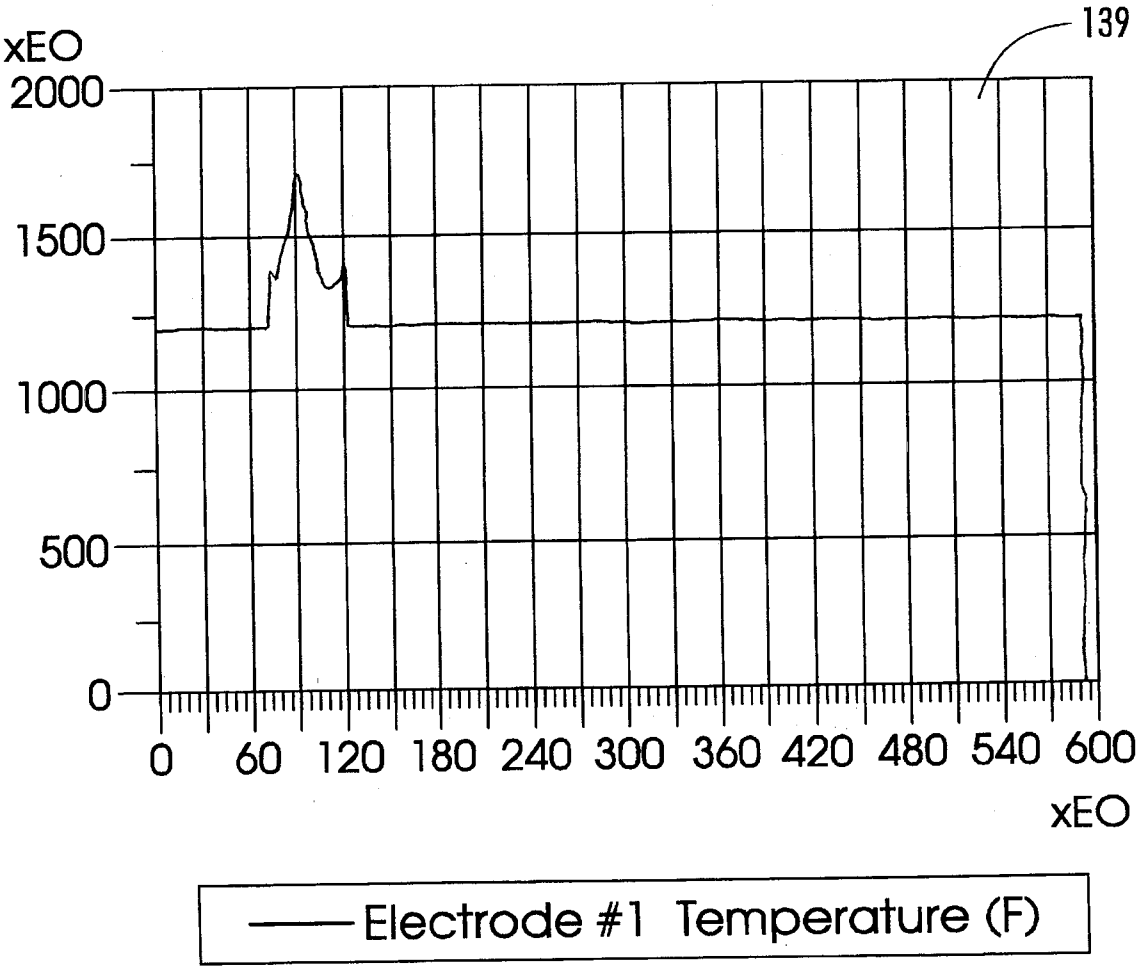
Figure 7D:
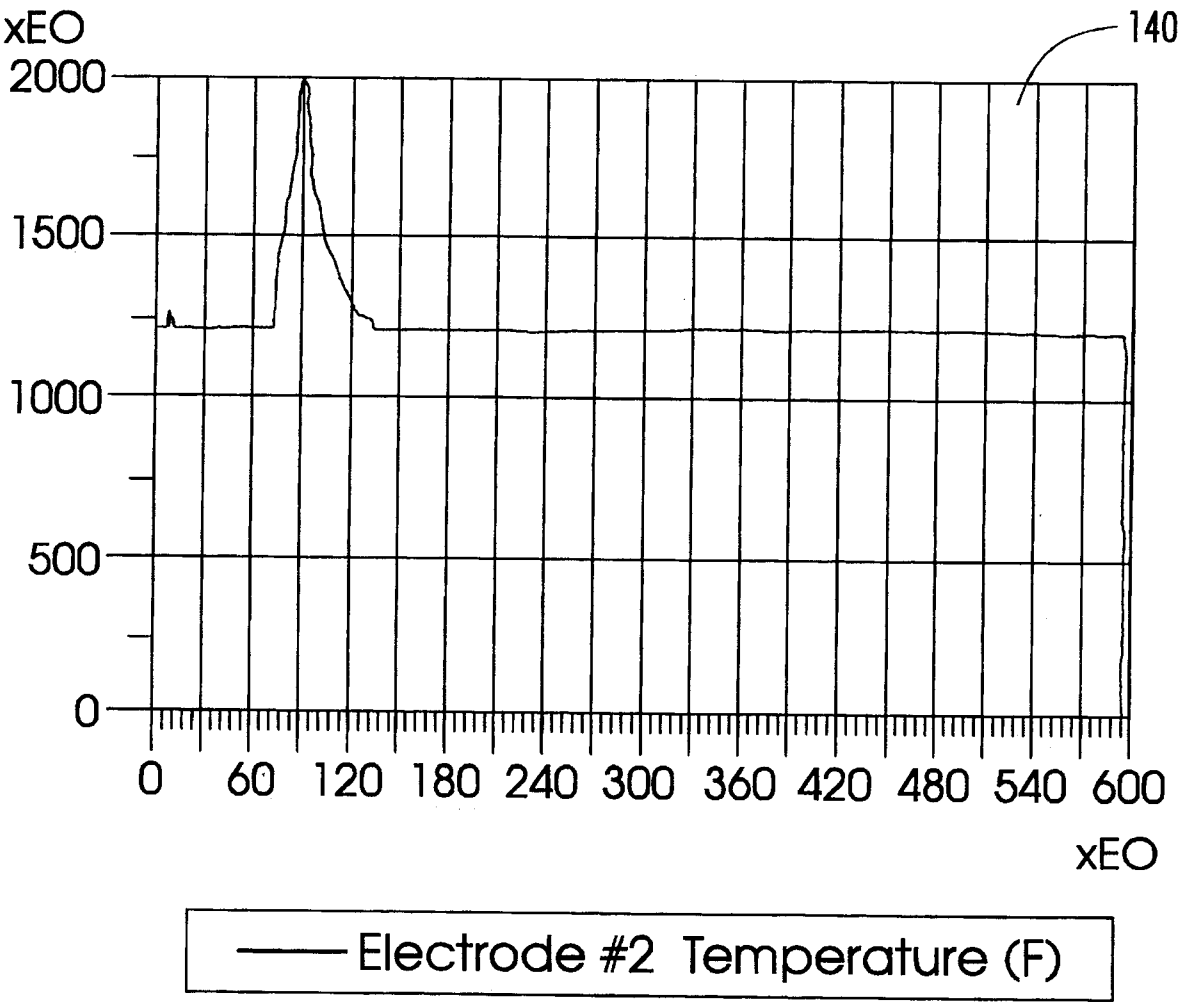
Figure 8:
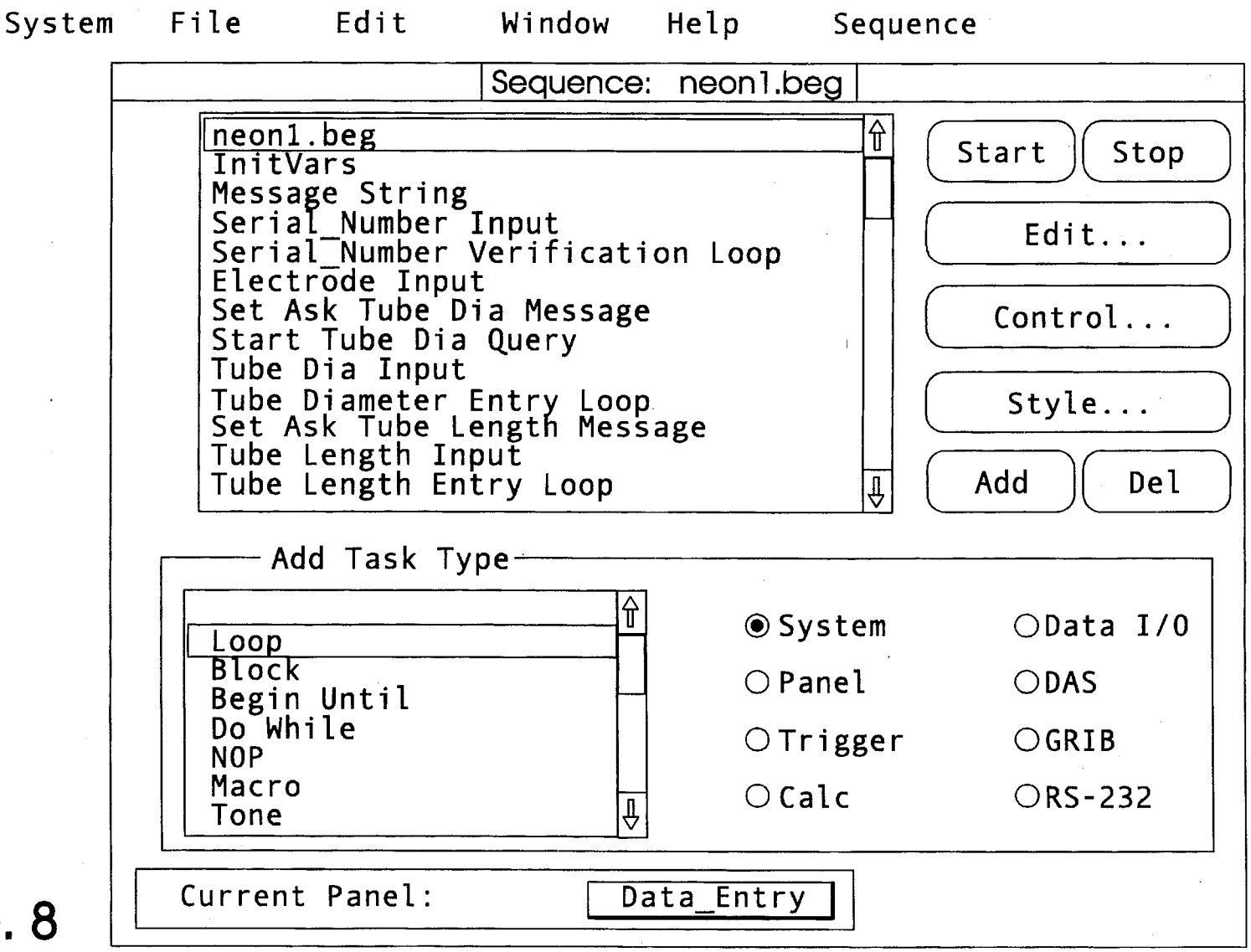
FIG. 8 is a representative view of a computer screen used in accordance with the invention.

Corresponding to the screen in FIG. 4 and as shown in FIGS. 5A–5C, 6A–6B, 7A–7D, and 8, are individualized processing screens for thermocouple temperatures (FIG. 5A–5C), fill and vacuum pressure readings (FIG. 6A–6B), current readings and electrode temperatures (FIG. 7A–7D), as measured by the optical pyrometers of the system, as well as the main program screen (FIG. 8). The user may toggle back and forth from any screen simply by selecting the appropriate screen from the menu. That is, if the user selects thermocouple 116 with the pointer (not shown) of the mouse 91 or keyboard controlled cursor (not shown), the display shown in FIG. 5A shall appear.

Similarly, if the user selects vacuum display 118, current display 120 or pyrometer display 111 and 113, or main display 122, the display shown in FIGS. 6A, 7A, and 8 respectively appear on the screen 88 of the monitor 86.

Figure 5A:
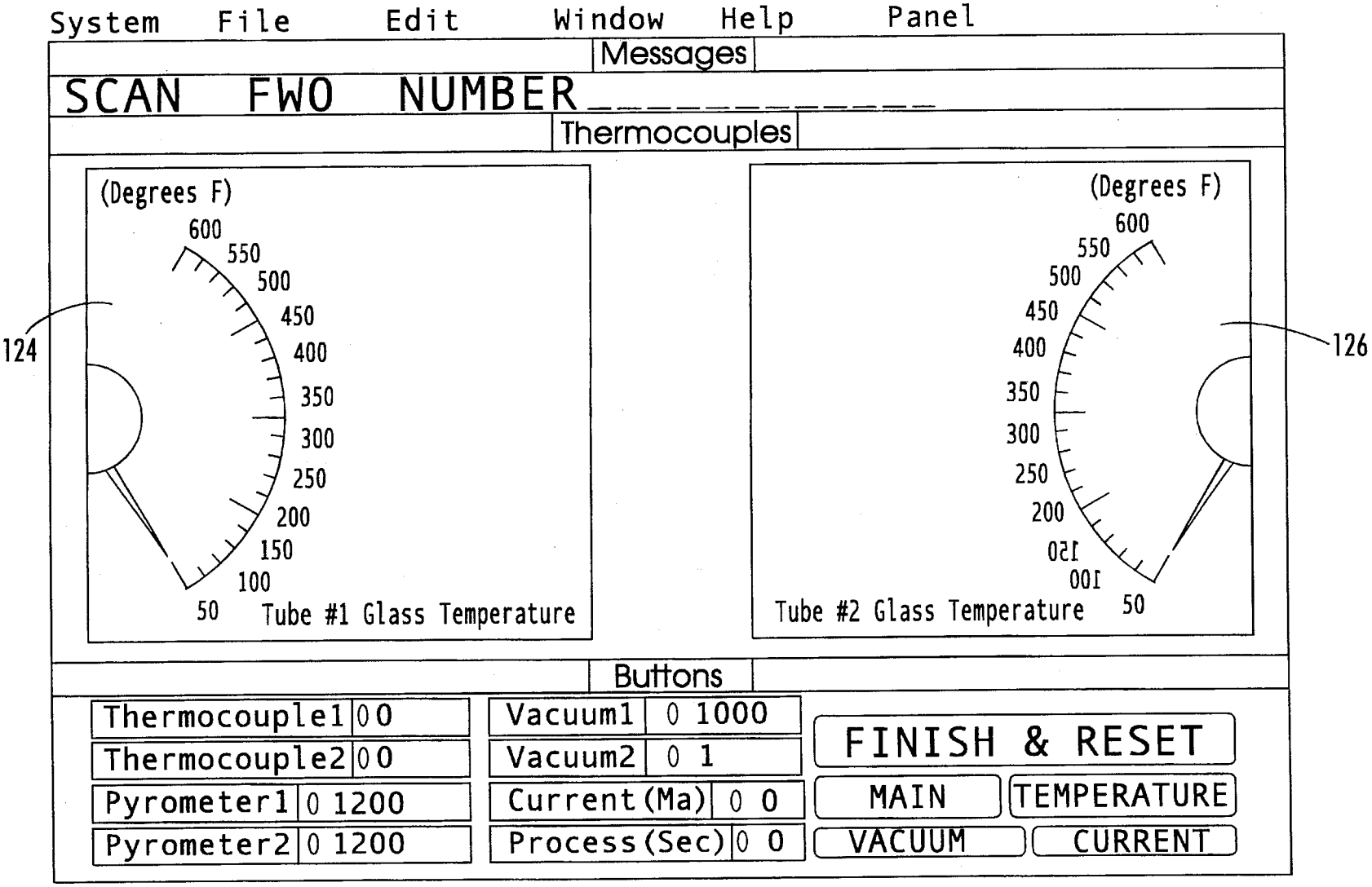
FIG. 5A–5C is a representative view of a series of computer screens used in accordance with the invention.
Figure 5B:
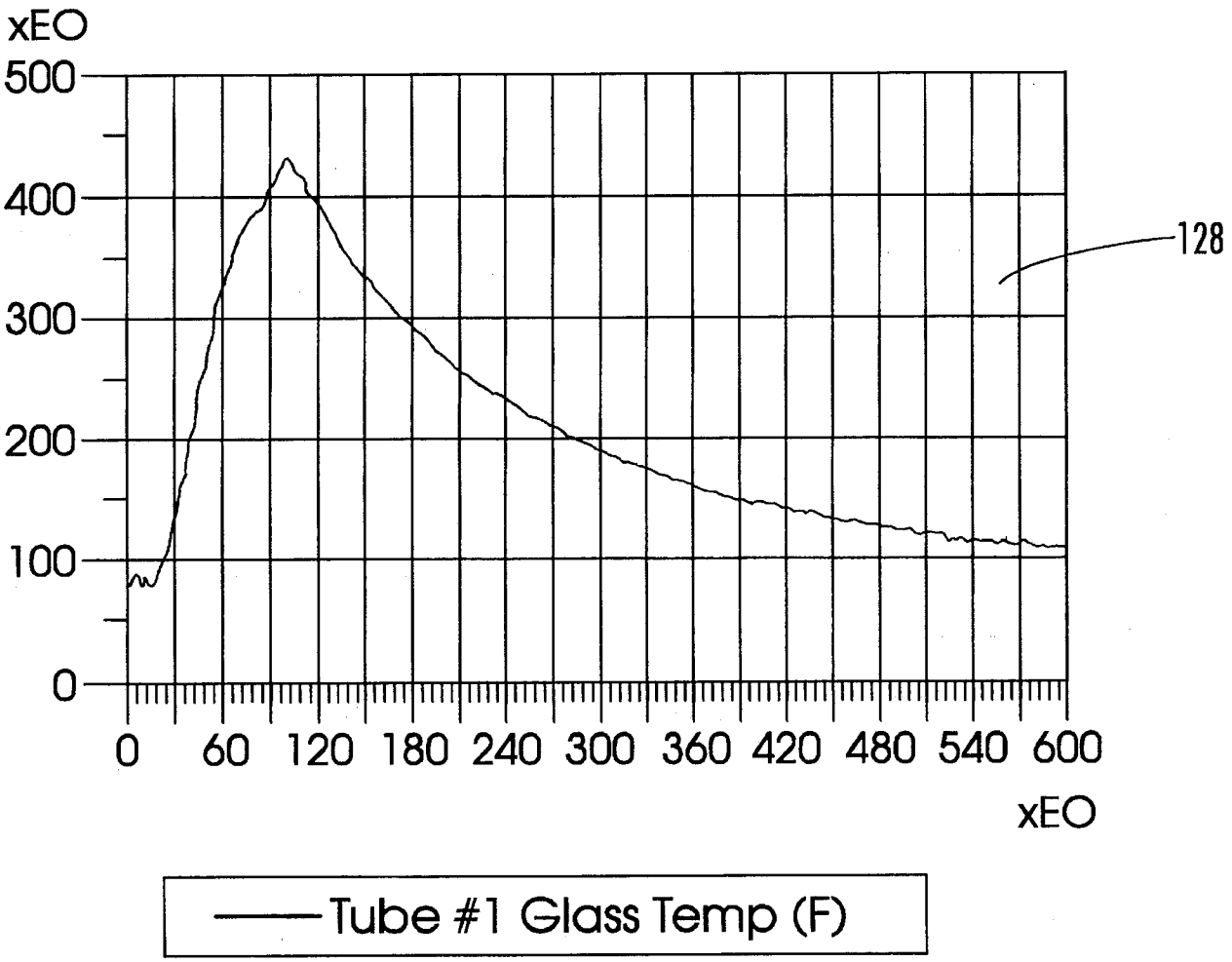
Figure 5C:
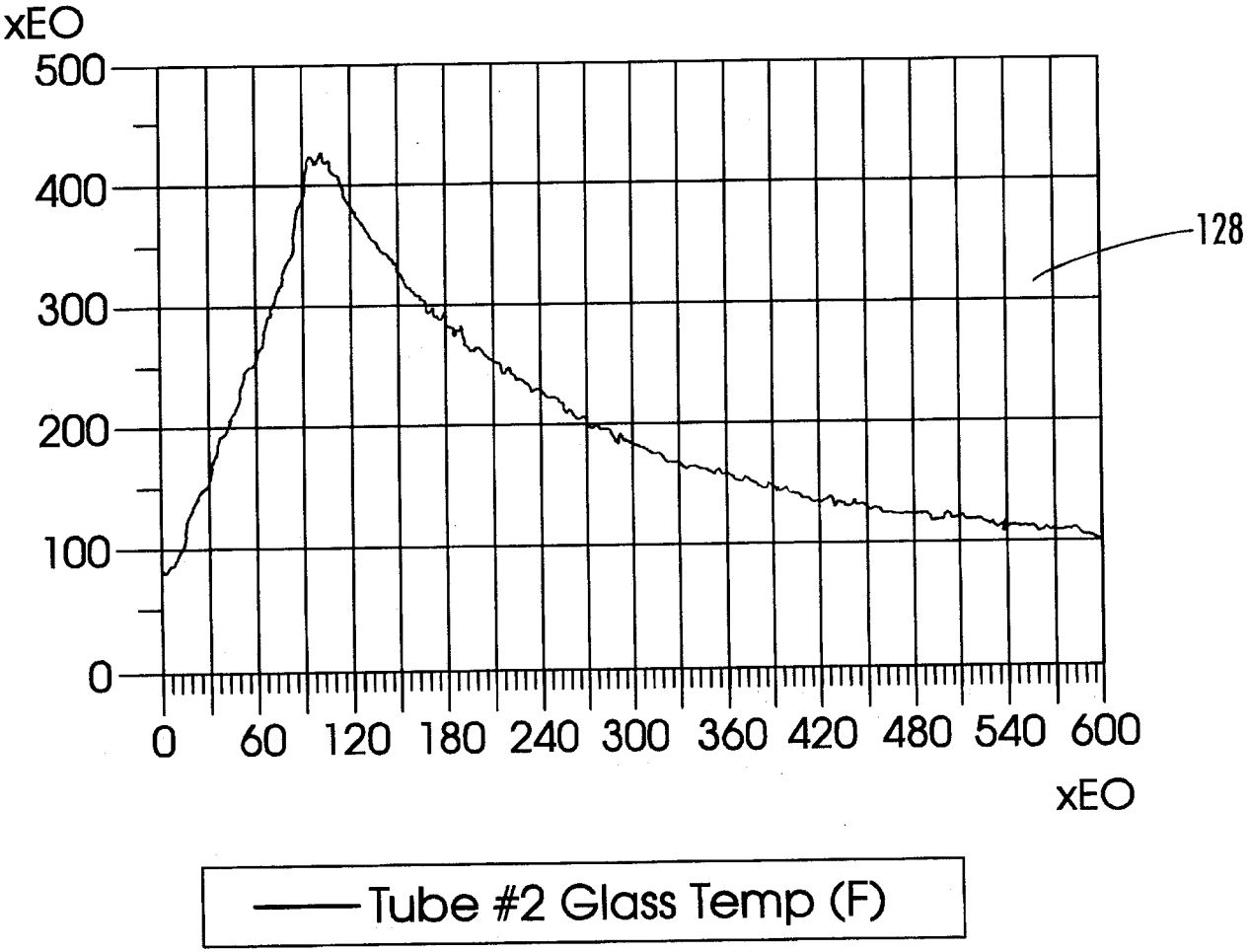

With reference to FIG. 5, if the user selects the thermocouple display, read-outs 124 and 126 corresponding to thermocouple I 112 and thermocouple II 114, respectively, are indicated. In addition, bar graph section 128 can plot either of the thermocouple readings 124 and 126 on a graphic display versus time (FIGS. 5B and 5C). That is, the thermocouple reading appears on the vertical axis and the time appears on the horizontal axis as indicated.

Similarly, with reference to FIGS. 6A–6B, if the user selects the vacuum option from the menu of FIG. 4, the display in FIG. 6A is shown. This display in FIG. 6A reveals gauges 130–133. Bar graph 134 is provided to plot the manifold vacuum readings in graphical form as a function of time as monitored by readout 133 of FIG. 6A. That is, the vertical axis of the graph corresponds to the vacuum reading and the horizontal axis corresponds to the elapsed time.

If the user selects the current option 120 from the menu shown in FIG. 4, the display of FIG. 7A is presented. The display of FIG. 7A incorporates a current indicator 135 and pyrometer I readout 136 and pyrometer II readout 137. The current and pyrometer measured temperatures may also be plotted on the graph 138–140 (FIGS. 7B–7D). Graph 138 positions the current level along the vertical axis and the elapsed along the horizontal axis. Graph 139 and 140 position the electrode temperature on the vertical axis and the elapsed time along the horizontal axis.

With reference to FIGS. 4 and 8, if the user selects the main option 122 from FIG. 4, the display of FIG. 8 is shown on the screen 88 of the monitor 86.

INSTRUMENTATION

Instrumentation will include but not necessarily be limited to the following:

A vacuum pump system capable of achieving a vacuum of $10^{-3}$ Torr (1 micron) preferably within two (2) minutes. The mechanical backing pump should have a non-return valve to prevent the pump oil from backing up out of the pump. The main pump (backing pump) should be assisted by a finish pump (turbomolecular pump or diffusion pump) to achieve the specified degree of vacuum in a minimum time frame. Diffusion pumps will utilize silishell based fluids due to their inherent thermal stability and low level of reactance. Mercury based diffusion pumps are generally not acceptable due to potential contamination of the manifold and risk of exposure of employees to mercury vapors. The pumping system must be properly maintained so as to ensure the designated degree of vacuum and to prevent contaminants from entering the manifold system. A log should be used to record all maintenance performed. (Since maintenance has significant impact on overall system performance, an alternate embodiment of the invention will record component maintenance data on all components of the Data Acquisition System.

A gauge (or gauges) capable of continuously measuring vacuum from 40 Torr to $10^{-4}$ Torr Gauges are preferably hardened to protect against "flashback." Flashback is created when the path of least electrical resistance is through the pumping manifold instead of between the electrodes of the tubing being processed. Gauges should therefore be capable of being taken off line at various points in the processing and reintroduced when additional vacuum is applied. Caution must be taken when using a bellows or diaphragm type gauge to measure the back filling of inert gas in the tube. If too much gas is admitted to the tube and then some is vacuumed off, this type gauge may provide an inaccurate reading through such a narrow range due to hysterhesis.

A gauge capable of showing pressure of inert gas reintroduced into the glass tubing (one of the vacuum gauges may be sufficient). Fill gauges should scale in the range of 0 to 20 mm Hg. A milliammeter capable of continuous display in the range of 0 to 1000 milliamperes is necessary to measure current during processing.

A thermocouple or other device which can indicate glass temperature with a ±5% accuracy. Temperature crayons or strips do not provide continuous monitoring of the process and thus give limited control to the process.

One or more Williamson optical pyrometers (preferably Tempmatic 9000 series), with positionable sensing heads. The minimum range of service must be 1200–2000 degrees Fahrenheit. Sensing heads should be equipped with an aiming point to insure readings are from the electrode shell and not the exterior glass housing.

A bombarding transformer having a minimum rating of 7.5 KVA. Operating parameters will include the capacity to generate 10,000 to 25,000 volts. Best efficiency comes from a transformer designed to operate on 220 volt primary circuit. Current must be regulated within a range of 200 to 800 milliamperes (minimum). Due to the ease of operation and the enhanced control, a dial type rheostat capable of controlling current within ±25 milliamperes is preferable to other forms of current regulation. The bombarder must be properly insulated to conform to OSHA standards. The bombarder must be controlled so as to require positive action to activate. The use of an enclosed magnetic switch with a push button control is preferred.

Connections must be provided between the high voltage terminals of the bombarder and the electrodes of the glass tubing. The leads should be thoroughly insulated and should attach to the electrodes by, for example, means of spring-jaw type clamps covered by rubber hoods.

A burn-in table should also be provided to age processed tubes. The table should be provided with a 60 milliampere transformer and insulated leads for connecting the secondary terminals of the transformer to the glass tubing. All pieces of tubing should be burned in for a minimum of 30 minutes on a 60 milliampere transformer. This aging cycle should be controlled so as to cycle the unit on for two and off for one during the first 15 minutes, followed by a 15 minutes period of continuous burn. Glass tubing which exhibits signs of impurities after this aging cycle must have electrodes replaced and be reprocessed or be scrapped.

What is claimed is:

1. A method of manufacturing illuminatable tubing in accordance with a prescribed set of manufacturing parameters, comprising the steps of:

(a) providing a length of glass tubing having spaced apart ends;

(b) sealing off the ends of the glass tubing by attaching an electrode to each of the spaced apart ends;

(c) tubulating the glass tubing;

(d) attaching the tubulated glass tubing to a manifold and evacuating the glass tubing;

(e) attaching a current source to the electrodes;

(f) heating the glass tubing by introducing an electric arc between the electrodes inside the glass tubing to enable the electrodes to burn off impurities;

(g) monitoring and recording information corresponding to the current to the electrodes as a function of time and comparing the information to the prescribed set of manufacturing parameters;

(h) monitoring and recording information relating to the temperature of the glass tubing as a function of time and comparing the information the prescribed set of manufacturing parameters;

(i) evacuating the glass tubing;

(j) monitoring and recording information relating to the vacuum within the glass tubing as a function of time and comparing the information to the prescribed set of manufacturing parameters;

(k) filling the glass tubing with an inert gas; and (l) sealing the glass tubing.

2. The method of claim 1 wherein step (b) includes the steps of:

applying a bar code identification tag to the glass tubing, reading the identification number with a bar code wedge and recording the manufacturer of the electrode.

3. The method of claim 1 including the step of:

adding mercury to the glass tubing.

4. The method of claim 1 including the step of:

burning in the glass tubing.

5. The method of claim 1 wherein the filling step includes the step of monitoring the fill pressure of the fill gas.

6. A method of manufacturing illuminatable tubing and monitoring the manufacturing parameters in order to correspond with a predetermined set of quantitative parameters such as current, temperature, and pressure, the method comprising the steps of:

(a) providing a length of glass tubing having spaced apart ends;

(b) sealing off the ends of the glass tubing by attaching an electrode to each of the spaced apart ends;

(c) tubulating the glass tubing;

(d) attaching the tubulated glass tubing to a manifold and evacuating the glass tubing;

(e) attaching a current source to the electrodes;

(f) introducing an electric arc between the electrodes inside the glass tubing to heat the glass tubing enabling the electrodes to burn off impurities, and quantitatively monitoring and recording the current applied to the electrodes as a function of time;

(g) comparing the recorded current information with a predetermined quantitative current parameter;

(h) attaching a thermocouple to the glass tubing and quantitatively monitoring and recording the temperature of the glass tubing as a function of time;

(i) comparing the recorded temperature information with a predetermined quantitative temperature parameter;

(j) evacuating the glass tubing and quantitatively monitoring and recording the vacuum pressure within the glass tubing as a function of time;

(k) comparing the recorded pressure information with a predetermined quantitative pressure parameter;

(l) filling the glass tubing with an inert gas; and (m) sealing the glass tubing.

7. The method of claim 6 wherein step (b) includes the steps the steps of:

applying a bar code identification tag to the glass tubing, reading the identification number with a bar code wedge and recording the manufacturer of the electrode.

8. The method of claim 6 including the step of:

adding mercury to the glass tubing.

9. The method of claim 6 including the step of:

burning in the glass tubing.

10. The method of claim 6 wherein the filling step includes the step of monitoring the fill pressure of the fill gas.

11. A system for manufacturing illuminatable tubing, comprising:

(a) a length of tubulated glass tubing having spaced apart ends;

(b) an electrode attached to each end of the glass tubing sealing off the tube ends;

(c) manifold means for controlling the pressure of the gas within the glass tubing;

(d) current means for applying an electric current to the electrodes to establish an electric arc therebeteween;

(e) thermocouple means for measuring the temperature of the tubulated glass tubing;

(f) data acquisition means for monitoring and collecting information relating to any of:

the pressure of the gas within the glass tubing, the amount of current applied to the electrodes, and the temperature of the tubulated glass, for enabling the manufacturer of the illuminatable tubing to compare the data monitored and collected to a set of prescribed manufacturing parameters.

12. The system of claim 11 further including:

an optical pyrometer for measuring the temperature of the electrode.

13. The system of claim 11 wherein the manifold means includes:

at least one vacuum gauge.

14. The system of claim 11 further including:

a vacuum gauge at an end of the glass tubing opposite the manifold.

15. The system of claim 11 further including:

bar code means for storing manufacturing data and corresponding the manufacturing data with a specific length of glass tubing.

16. A system for manufacturing illuminatable tubing in accordance with a set of proscribed manufacturing parameters, comprising:

(a) a length of tubulated glass tubing having spaced apart ends;

(b) an electrode attached to each end of the glass tubing sealing off the tube ends;

(c) a gas pressure manipulating manifold;

(d) a current source;

(e) at least one thermocouple;

(f) a data acquisition device means for enabling the manufacturer of the illuminatable tubing to monitor and record information relating to any of:
the pressure of the gas within the glass tubing,
the amount of current applied to the electrodes, and
the temperature of the tubulated glass, and for further enabling the manufacturer of the illuminatable tubing to compare the information with a set of proscribed manufacturing parameters.

17. The system of claim 16 further including:

an optical pyrometer for measuring the temperature of the electrode.

18. The system of claim 16 wherein the manifold means includes:

at least one vacuum gauge.

19. The system of claim 16 further including:

a vacuum gauge at an end of the glass tubing opposite the manifold.

20. The system of claim 16 further including:

bar code means for storing manufacturing data and corresponding the manufacturing data with a specific length of glass tubing.

* * * * *